US012116802B2

(12) United States Patent
Schittkowski

(10) Patent No.: US 12,116,802 B2
(45) **Date of Patent: *Oct. 15, 2024**

(54) POOL STORAGE BASKET

(71) Applicant: CA-SA PRODUCT GmbH, Olfen (DE)

(72) Inventor: Jan Schittkowski, Olfen (DE)

(73) Assignee: CA-SA PRODUCT GmbH, Olfen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/605,383

(22) Filed: Mar. 14, 2024

(65) Prior Publication Data

US 2024/0218690 A1 Jul. 4, 2024

Related U.S. Application Data

(63) Continuation of application No. 17/877,351, filed on Jul. 29, 2022, now Pat. No. 11,982,098.

(30) Foreign Application Priority Data

Nov. 29, 2021 (EM) ..... 008780522-0001
Jul. 18, 2022 (DE) ..... 20 2022 104 031.1

(51) Int. Cl.
*E04H 4/14* (2006.01)

(52) U.S. Cl.
CPC ..... *E04H 4/14* (2013.01)

(58) Field of Classification Search
CPC ..... E04H 4/14; E04H 4/0056
USPC ..... 4/496, 500, 488, 498; 482/55
See application file for complete search history.

(56) References Cited

U.S. PATENT DOCUMENTS

| | | | | |
|---|---|---|---|---|
| 8,025,172 | B1 * | 9/2011 | Zink | E04H 4/14 220/756 |
| 9,926,714 | B2 * | 3/2018 | Cusic | E04H 4/14 |
| 2017/0130478 | A1 * | 5/2017 | Cusic | E04H 4/14 |
| 2022/0379989 | A1 * | 12/2022 | Goodman | B62J 9/23 |
| 2023/0111695 | A1 * | 4/2023 | Higashi | B62J 50/22 174/50 |
| 2023/0167652 | A1 * | 6/2023 | Schittkowski | E04H 4/14 4/496 |

FOREIGN PATENT DOCUMENTS

| | | | | |
|---|---|---|---|---|
| CN | 206928712 U | * | 1/2018 | A63B 69/12 |
| CN | 215322997 U | * | 12/2021 | |
| CN | 216102551 U | | 3/2022 | |
| CN | 217048907 U | * | 7/2022 | B62J 11/00 |
| CN | 218877473 U | * | 4/2023 | B62J 11/00 |
| CN | 219007992 U | * | 5/2023 | B62J 11/00 |
| EP | 4001076 A1 | * | 5/2022 | B62J 11/00 |

* cited by examiner

*Primary Examiner* — Lori L Baker
(74) *Attorney, Agent, or Firm* — Nixon & Vanderhye P.C.

(57) ABSTRACT

A storage basket for hanging on a peripheral edge of an above-ground pool is disclosed having hanging brackets. The hanging brackets include spacers, the spacers are spring, and the spacers are adjustable to any distance between the pool wall and the storage basket.

15 Claims, 6 Drawing Sheets

POOL STORAGE BASKET

RELATED APPLICATIONS

This application is a Continuation of U.S. patent application Ser. No. 17/877,351, filed Jul. 29, 2022, now allowed, which claims priority to German Application Number DE 20 2022 104 031.1 filed Jul. 18, 2022, and European Union Design Application Number 008780522-0001 filed Nov. 29, 2021, the disclosures of each of which are hereby incorporated by reference herein in their entirety.

BACKGROUND

The present invention relates to a storage basket for hanging on the peripheral edge of an above-ground pool according to the features in the preamble of claim 1.

Outdoor pools on private property are becoming increasingly popular. Originally, built-in pools were usually built, in which case a corresponding pit is dug and a pool system is embedded in the ground. However, built-in pools are expensive to buy, require a lot of space and cannot be easily removed again.

So-called above-ground pools have therefore established themselves in the prior art. These can be set up quickly and easily on private property without extensive structural measures. In addition, they are significantly cheaper to buy, require less space and can also be removed quickly.

Above-ground pools can be placed directly on the ground and filled with water. The basins usually consist of a solid or flexible plastic wall that is connected to a peripheral tubular frame. The tubular frame is held up in its vertical direction by a plurality of supports. The supports are arranged around the above-ground pool.

When using the pool, a wide variety of utensils are typically used. For children, this is mostly toys in the form of diving goggles, water pistols or balls. Adults should often have sunscreen, drinks, books or mobile phones within reach.

Since above-ground pools are often over 1.4 m high, items cannot be placed on the ground next to the pool and used from inside the pool at the same time. As a rule, above-ground pools do not have a basin edge on their frame on which objects could be placed.

Therefore, there are various solutions in the prior art in order to be able to store objects within reach at the pool. For example, storage baskets that can be hung on the peripheral edge of the above-ground pool are known. To ensure that the storage basket is hung in a horizontal orientation, fixed spacers can be arranged on the storage basket, which keep the storage basket at a distance from the pool wall.

However, these have two major disadvantages. On the one hand, the spacers are not adjustable to accommodate different distances between the pool wall and the storage basket. It is therefore not ensured that the storage baskets are always hung in an exactly horizontal orientation in differently designed above-ground pools, since there are different distances between the pool wall and the storage basket depending on the design of the above-ground pool.

The second disadvantage lies in the rigid design of the spacers. When the pool is in use, the outer walls and the frame construction of the above-ground pool are in constant motion due to the turbulence of the water. Due to the rigid spacers, this movement is transmitted directly to the storage basket, so that objects in it are also moved and possibly damaged. Furthermore, due to the rigid design of the spacers, the pool wall can be damaged if there is increased friction between the pool wall and the spacer.

SUMMARY

The object of the present invention is therefore to provide an improved storage option for hanging on the peripheral edge of an above-ground pool, which can be easily installed on different above-ground pools and is also designed to be operationally reliable.

The above task is solved with a storage basket for hanging on the peripheral edge of an above-ground pool with the features of claim 1.

Advantageous embodiments are the subject-matter of the dependent claims.

The storage basket according to the invention is designed to be hung on the peripheral edge of an above-ground pool. It is preferably an above-ground pool with a tubular frame surrounding the top, wherein a pool tarpaulin or pool wall suspended from the tubular frame extends downwards.

The storage basket has hanging brackets for hanging, which in turn have spacers. In particular, the storage basket is hung in such a way that its main body is arranged on the outside of the pool.

According to the invention, the storage basket is now characterised in that the spacers are spring means. The spring means provide a defined and adjustable distance between the pool wall and the storage basket so that the storage basket is hung in a substantially horizontal orientation. The force transmitted from the outer pool wall to the storage basket is dampened by the spring means when the pool is used with the accompanying movement of the outer pool wall and the peripheral edge. This has the advantage that the storage basket remains in its horizontally oriented position, even if the outer wall of the pool moves more vigorously. Items in the storage basket are thus not inclined and tipped over, which could otherwise damage the items.

Furthermore, the spring means ensure that the spacer does not damage the outer wall of the pool when there is a movement of the outer wall of the pool as a result of use. The otherwise usual rigid design of the spacer can result in damage to the outer pool wall due to the increased friction. This is avoided by the spring means according to the invention, since they yield when force is applied.

The walls of above-ground pools are mostly fixed and made of sheet metal or plastic, or flexible and made of a pool tarpaulin. While the fixed pool walls run in an exactly vertical direction, the flexible pool walls below the frame have a teardrop shape that curves outwards. A further advantage of the spring means is therefore that they can be automatically adapted to the curved shape of the pool walls.

Two hanging brackets are preferably arranged at the ends of the storage basket. This arrangement ensures the greatest possible stability of the storage basket in the suspended state.

The hanging brackets can be fixedly or detachably coupled to the storage basket. The latter enables particularly cost-effective production, since the basket and the hanging bracket can be produced separately. When shipping and storing the storage baskets, the baskets can be stacked and the hanging brackets stowed separately from the baskets.

In a preferred embodiment of the invention, the spring means can be adjusted to any distance between the pool wall and the storage basket. This has the advantage that the storage basket can always be hung up horizontally, even if there are different distances between the pool wall and the storage basket. Thus, the storage basket according to the invention can also be safely used for different pool sizes and different embodiments of above-ground pools.

The spring means are designed in particular as tabs and are preferably firmly connected at their lower end to the lower end of the hanging bracket.

The hanging brackets preferably have snap-in openings arranged vertically one above the other in the middle region of their shaft. The upper ends of the spring means can be detachably coupled to these snap-in openings. Due to the different heights of the snap-in openings, the spring means designed as a tab are bulged out to different extents in the horizontal direction. If the upper end of the spring means is coupled with the lowest snap-in opening viewed in the vertical direction, the spring means are compressed to the maximum and the maximum adjustable distance between the storage basket and the region of the spring means that comes into contact with the outer wall of the pool is set. If the upper end of the spring means is positioned in the uppermost snap-in opening viewed in the vertical direction, the bulging of the spring means is significantly smaller, so that there is a smaller distance between the storage basket and the region of the spring means that comes into contact with the outer wall of the pool.

In particular, the spring means can bridge a region between 1 cm and 10 cm, preferably 1.5 cm to 7 cm and particularly preferably 2 cm to 5 cm, between the pool wall and the storage basket. It has been shown here that the storage basket can be adapted to the most common above-ground pool sizes.

The hanging brackets have a slight shoulder, especially in the inner curve of the bracket. The shoulder divides the bracket into two regions which are at different distances from the main body of the storage basket. Depending on the distance between the pool wall and the storage basket, the pool frame can be arranged in one of two regions. This further increases the maximum and minimum distance that can be bridged by the storage basket.

The storage basket is preferably made of a hole-like material, in particular a plastic material. This enables appropriate water permeability and ensures low material costs. The objects arranged in the storage basket can thus dry more quickly, since the dripping water can run through the storage basket. The storage basket is particularly preferably made of a flexible plastic material. This has the advantage that the storage basket gives way in the event of unwanted contact, for example with the head of a pool user, and thus no injuries occur.

In an advantageous embodiment of the storage basket, the latter has an upper peripheral frame which has increased connection rigidity compared to the hole-like material of the rest of the storage basket. This enables a stable shape of the storage basket, which also withstands movements of the pool due to use.

In particular, the storage basket has a rectangular configuration. Here again it has been shown that this configuration provides an optimum of stability and space.

In an alternative embodiment, the storage basket can also be curved outwards in plan view.

DESCRIPTION OF THE DRAWINGS

Further advantages, features, properties and aspects of the present invention are the subject of the following description. Preferred embodiments are represented by schematic figures. These serve for a simple understanding of the invention.

DETAILED DESCRIPTION

Figure 1:
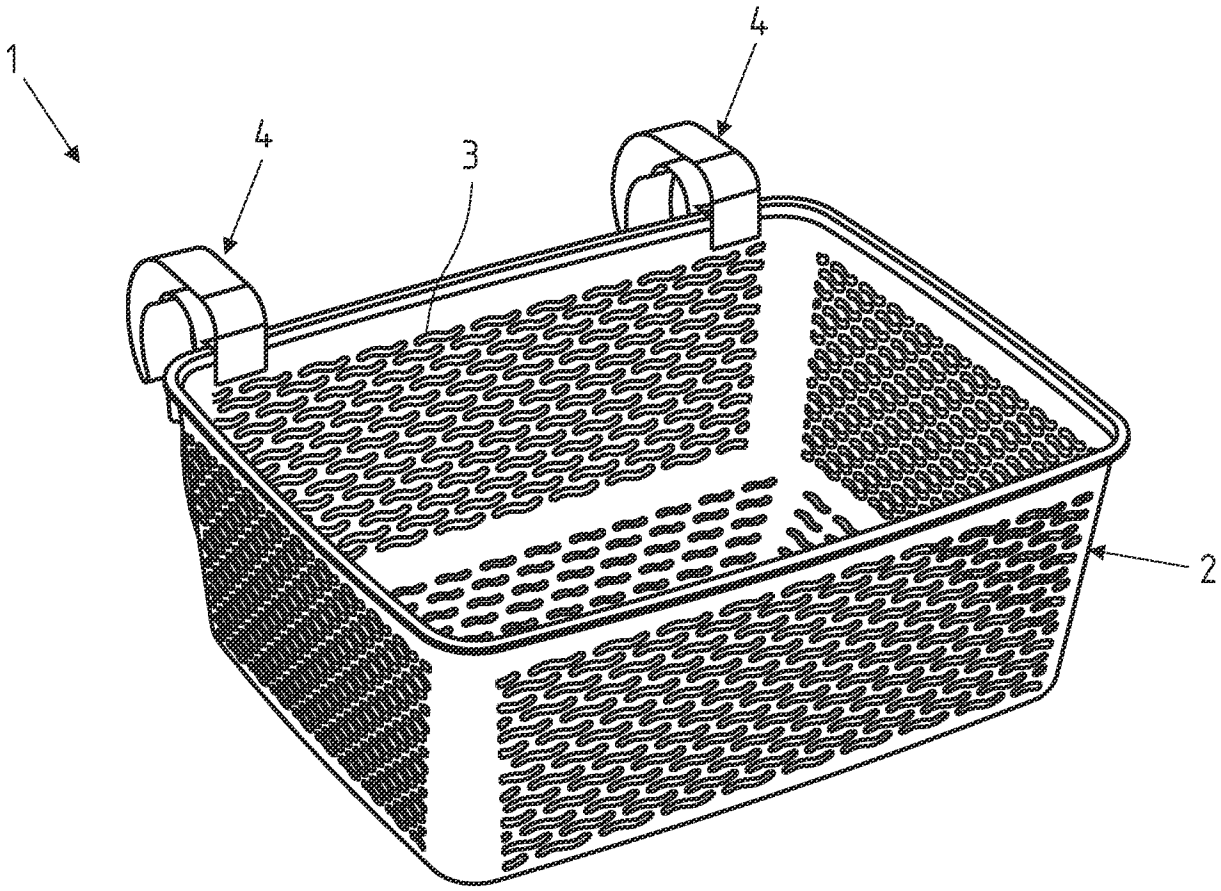
FIG. 1 shows a storage basket according to the invention in a perspective view.

In the figures, the same reference numerals are used for the same or similar components, even if a repeated description is omitted for reasons of simplification.

FIG. 1 shows a storage basket 1 according to the invention in a perspective view. The storage basket 1 has a substantially rectangular base body 2 which is open at the top. The base body 2 has a hole-like structure, with the holes 3 ensuring that water inside the storage basket 1 can drain off.

The storage basket 1 also has two hanging brackets 4 which are each arranged at the end of the storage basket 1.

Figure 2:
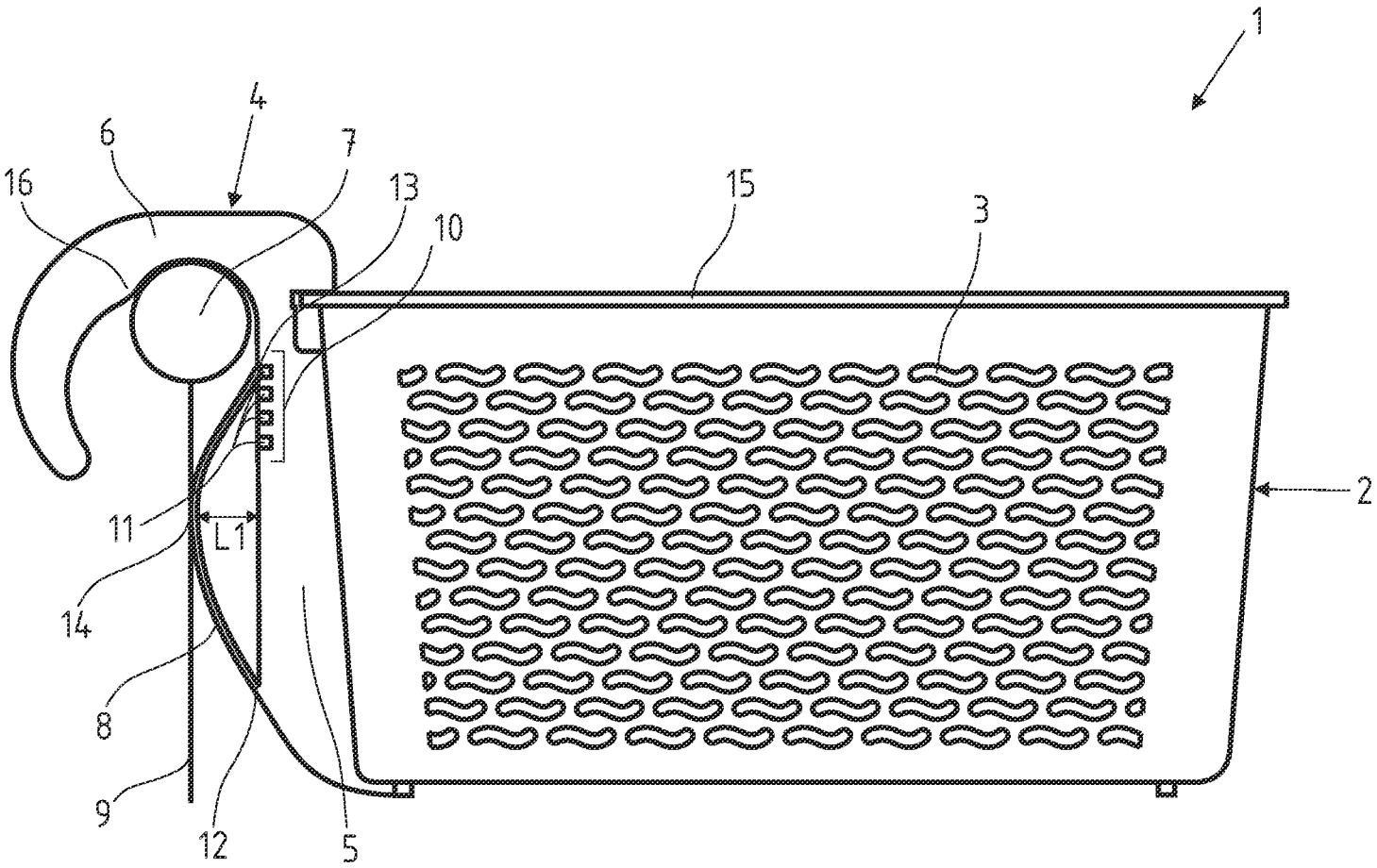
FIG. 2 shows a storage basket according to the invention in a side view.

It can be seen from FIG. 2 that the hanging brackets 4 are each formed from a shaft 5 and a bracket 6. The hanging brackets 4 are each detachably coupled to the base body 2 of the storage basket 1 at the upper and lower end of the shaft 5. The storage basket 1 is hung on the hanging bracket 4 on a peripheral tubular frame 7 of an above-ground pool.

The hanging brackets 4 also have spacers 8 in the form of spring means. The storage basket 1 is held at a distance L1 from the pool wall 9 via the spacers 8, so that the storage basket 1 is hung in a substantially horizontal orientation. The pool wall 9 is fixed here and runs substantially vertically. The storage basket 1 is arranged with its base 2 on the outside of the above-ground pool.

The hanging brackets 4 have snap-in openings 11 in a region 10 of their shaft 5. The spacer 8 is connected to the shaft 5 of the hanging bracket 4 at its lower end 12. At its upper end 13, the spacer 8 is detachably coupled to the uppermost snap-in opening 11 viewed in the vertical direction. The spacer 8 rests against the pool wall 9 at the point of its maximum bulge 14. This ensures that the storage basket is oriented substantially horizontal.

The storage basket 1 also has an upper peripheral frame 15 which has increased torsional rigidity. This increases the basic stability of the storage basket 1.

The hanging brackets 4 have a slight shoulder 16 in particular in the inner curve of the bracket 6. The shoulder 16 divides the bracket 6 into two regions which are at different distances from the base body 2 of the storage basket 1. The tubular frame 7 is arranged in the region with a smaller distance from the storage basket 1.

Figure 3:
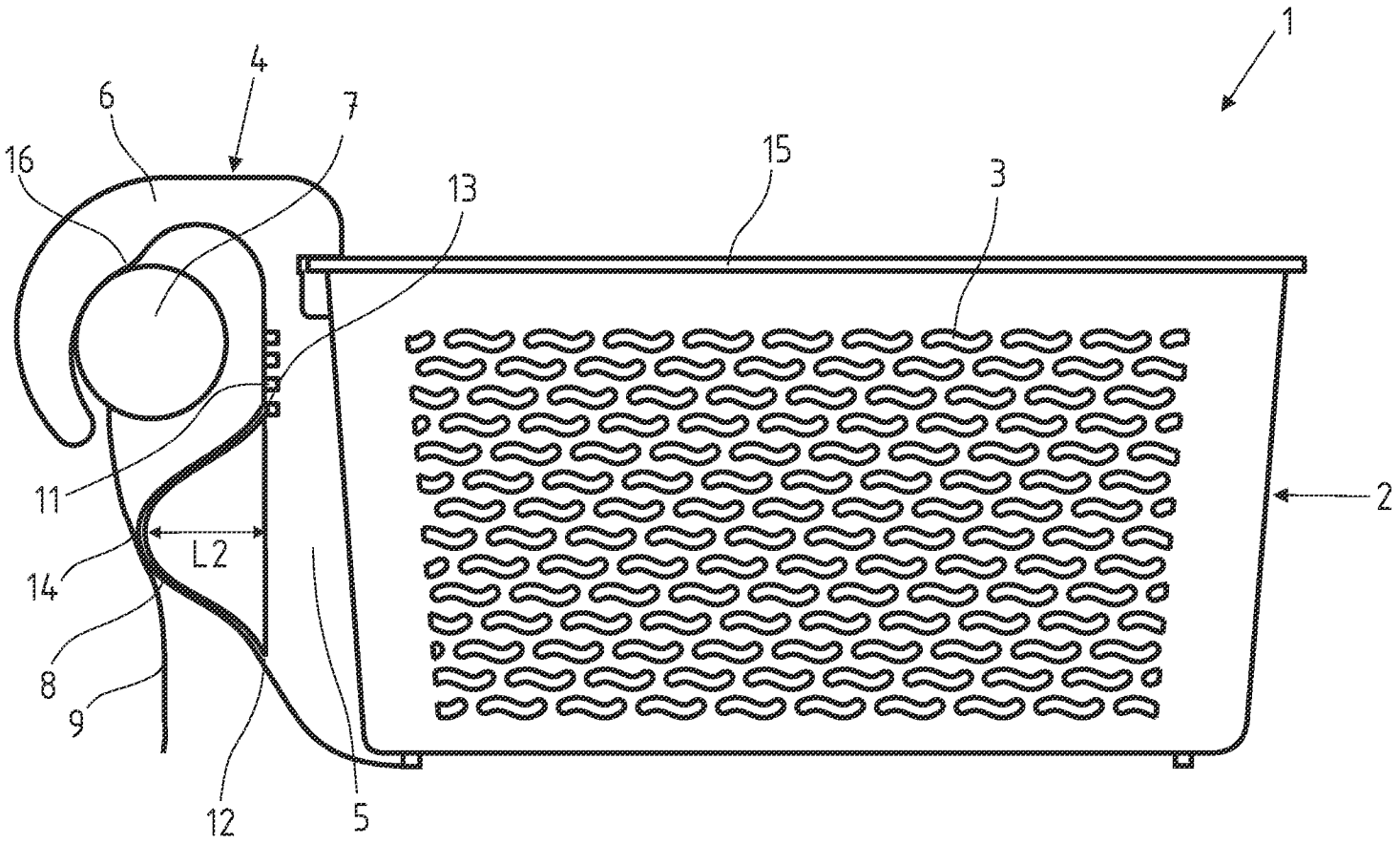
FIG. 3 shows a storage basket according to the invention in a side view.

FIG. 3 shows that when the spacer 8 is arranged in the lowermost snap-in opening 11 in the vertical direction, the distance L2 between the maximum bulge 14 and the shaft 5 of the storage basket 1 is greater than the distance L1 in the arrangement shown in FIG. 2. In this way, the respective distance L1, L2 can be adapted to the respective embodiment of the above-ground pool and it is ensured that the storage basket 1 is always hung in a substantially horizontal orientation.

The pool wall 9 is flexible in FIG. 3 and has a curved profile. The spacer 8 automatically adapts to the contour of the pool wall 9. The tubular frame 7 is arranged here in the region of the bracket 6 that is further away from the storage basket 1.

Figure 4:
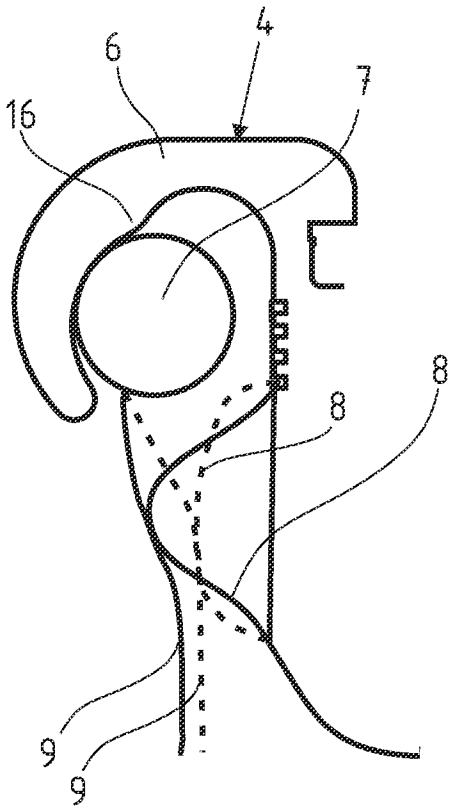
FIG. 4 shows a detailed view of a hanging bracket.

The spring principle of the spacer 8 is shown in FIG. 4. If the pool wall 9 is pressed outwards from its starting position (dashed line), the spacer 8 is deformed inwards (dashed line). In this way, the impact energy is cushioned and the storage basket 1 remains in its substantially horizontal orientation.

Figure 5:
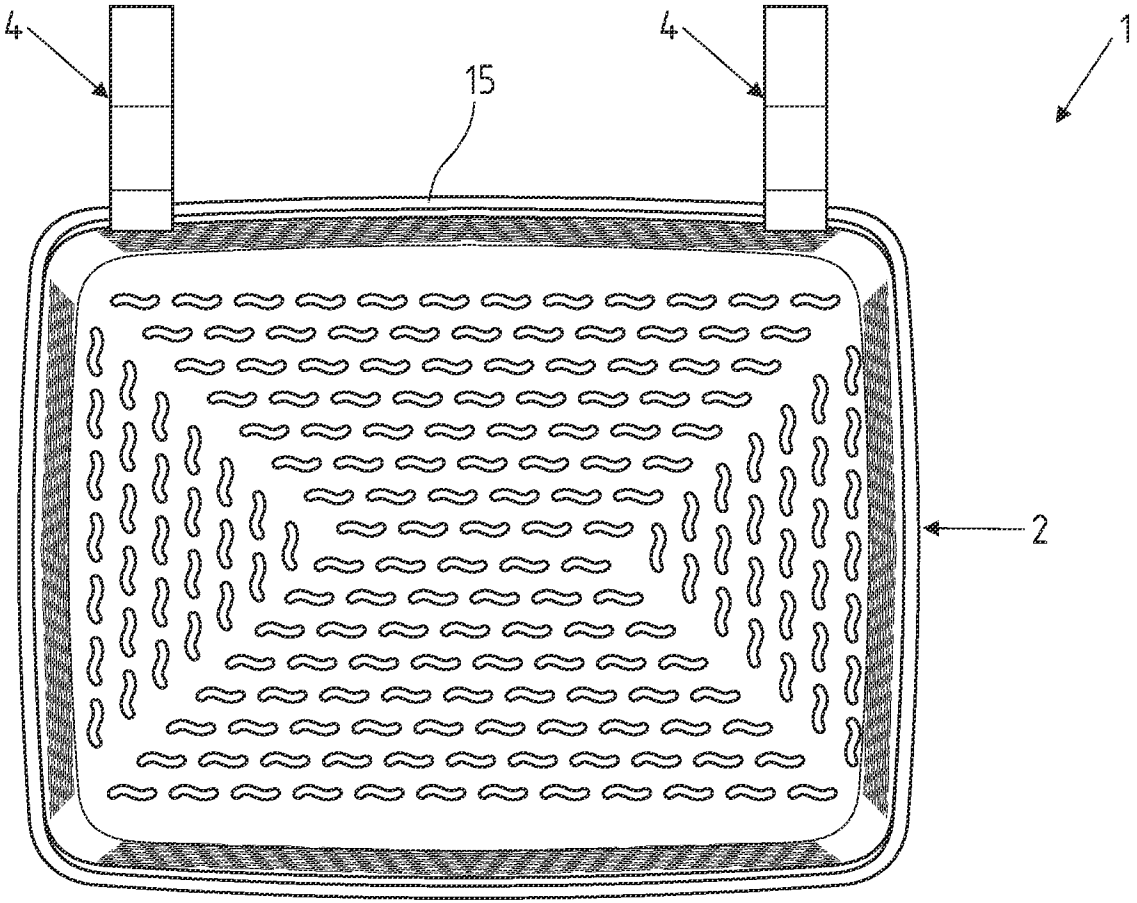
FIG. 5 shows a storage basket according to the invention in plan view.
Figure 7:
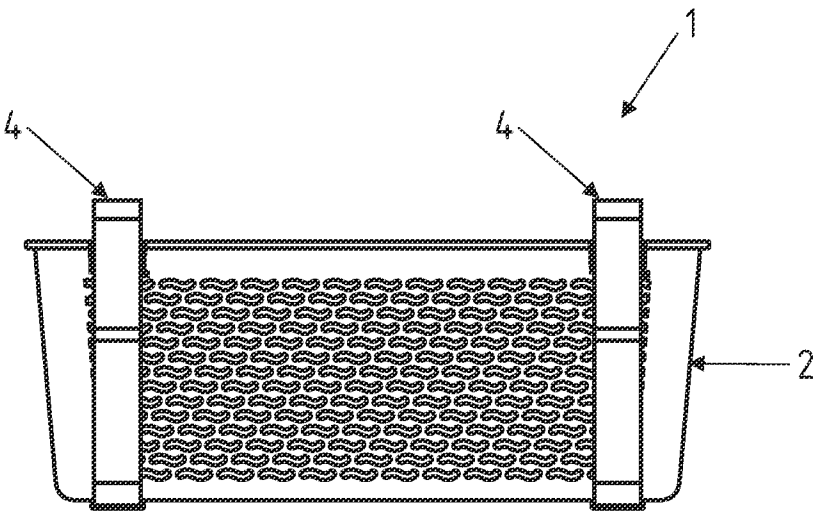
FIG. 6 shows a storage basket according to the invention in front view and FIG. 7 shows a storage basket according to the invention in rear view.
Figure 6:
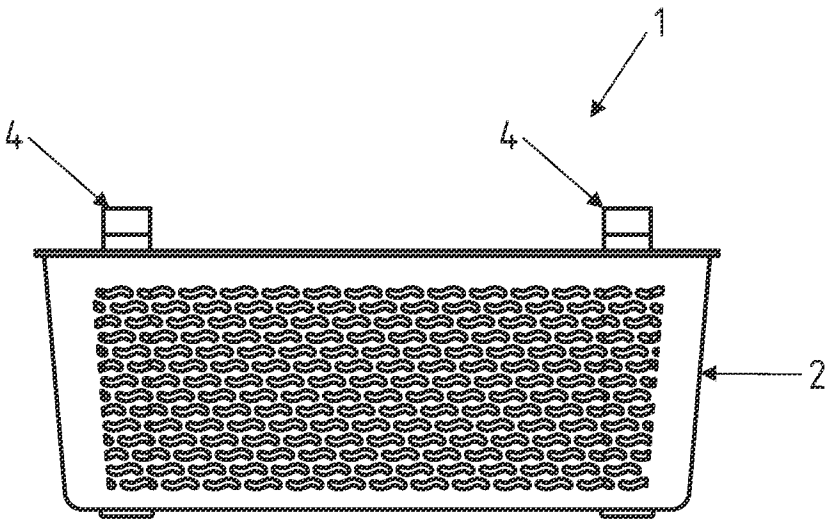

FIGS. 5 to 7 additionally show the storage basket according to the invention in a plan view and in a front and rear view.

The invention claimed is:

1. A storage basket for hanging on the peripheral edge of an above-ground pool, comprising:

a storage basket including hanging brackets, wherein the hanging brackets include spacers, wherein the spacers include springs, wherein the spacers are adjusted to any distance between the pool wall and the storage basket, such that the storage basket is hung substantially horizontally oriented at different distances between the pool wall and the storage basket.

2. The storage basket according to claim 1, wherein two hanging brackets are arranged at each end of the storage basket.

3. The storage basket according to claim 1, wherein the hanging brackets are firmly connected to the storage basket or that the hanging brackets are detachably coupled to the storage basket.

4. The storage basket according to claim 1, wherein the hanging brackets snap-in openings are arranged vertically one above the other.

5. The storage basket according to claim 1, wherein the spacers are designed as tabs.

6. The storage basket according to claim 1, wherein the spacers are connected at their lower end to the shaft of the hanging bracket.

7. The storage basket according to claim 1, wherein the spacers are detachably coupled at their upper end to one of the snap-in openings.

8. The storage basket according to claim 1, wherein the spacers are configured to cover a region between 1 cm and 10 cm, between the pool wall and the storage basket.

9. The storage basket according to claim 1, wherein the hanging brackets have a shoulder in the inner curve of the brackets.

10. The storage basket according to claim 1, wherein the storage basket is made of a perforated material.

11. The storage basket according to claim 1, wherein the storage basket has an upper peripheral frame having a greater torsional rigidity compared to the material of the storage basket.

12. The storage basket according to claim 1, wherein the storage basket has a rectangular configuration.

13. The storage basket according to claim 1, wherein the spacers are configured to cover a region between 1.5 cm to 7 cm between the pool wall and the storage basket.

14. The storage basket according to claim 1, wherein the spacers are configured to cover a region between 2 cm to 5 cm between the pool wall and the storage basket.

15. The storage basket according to claim 1, wherein the storage basket is made of plastic material.

* * * * *